US006263536B1

(12) United States Patent
Beales

(10) Patent No.: US 6,263,536 B1
(45) Date of Patent: Jul. 24, 2001

(54) SPRAY BRUSH FOR CLEANING SQUEEGEES

(76) Inventor: Erin Beales, 291 3rd St., Oakland, CA (US) 94607

( * ) Notice: Subject to any disclaimer, the term of this patent is extended or adjusted under 35 U.S.C. 154(b) by 0 days.

(21) Appl. No.: 09/268,200

(22) Filed: Mar. 11, 1999

(51) Int. Cl.[7] ..... A47L 25/00
(52) U.S. Cl. ..... 15/104.92; 15/21.1; 15/77
(58) Field of Search ..... 15/104.92, 21.1, 15/160, 29, 39, 77; 4/606

(56) References Cited

U.S. PATENT DOCUMENTS

| | | | | |
|---|---|---|---|---|
| 3,416,178 | * | 12/1968 | James | 15/104.92 |
| 3,457,574 | * | 7/1969 | Hirt | 15/77 |
| 4,502,175 | * | 3/1985 | Hillis | 15/104.92 |
| 4,863,302 | | 9/1989 | Herzfeld et al. . | |
| 5,044,036 | * | 9/1991 | Fujimoto | 15/88.1 |
| 5,398,363 | * | 3/1995 | Medearis | 15/104.92 |
| 5,649,334 | | 7/1997 | Henriquez et al. . | |
| 5,652,993 | * | 8/1997 | Kreyer | 15/104.92 |
| 5,794,301 | * | 8/1998 | Hietala | 15/104.92 |
| 5,802,664 | | 8/1998 | Mondigo et al. . | |

FOREIGN PATENT DOCUMENTS

| | | | | |
|---|---|---|---|---|
| 838701 | * | 6/1960 | (GB) | 15/160 |
| 2176392 | * | 12/1986 | (GB) | 15/104.92 |
| 95800 | * | 10/1960 | (NL) | 15/104.92 |

* cited by examiner

*Primary Examiner*—Randall E. Chin
(74) *Attorney, Agent, or Firm*—Robert Samuel Smith

(57) ABSTRACT

An apparatus and method for cleaning squeegees of the type having a handle with one edge joined to an edge of an elastomeric flat plate having a scraping edge. The apparatus includes a pair of brushes such as flat brushes used to scrub floors and supported facing one another so that bristles of one brush touch bristles of the other brush. A tube with a row of apertures is positioned along an upper edge of each brush An appropriate solvent is pumped through the tubes and flushes the surfaces of the plate of the squeegee as the plate is swiped between the brushes.

3 Claims, 3 Drawing Sheets

SPRAY BRUSH FOR CLEANING SQUEEGEES

FIELD OF THE INVENTION

This invention relates to a combination spray and brush cleaner apparatus and method and particularly to a brush holder including tubing having an array of spray orifices and featuring convenient positioning and replacement of the brushes.

PRIOR ART AND INFORMATION DISCLOSURE

The screen printing process involves the steps of:

providing a screen, stretched on a frame;

depositing an ink on the screen using appropriate means such as a roller;

"scraping" the excess coating off the screen using a sqeegee which leaves coating in apertures of the screen corresponding to the pattern to be transferred to the base (paper, cloth, printed circuit board, etc).

performing a second scraping step with a squeegee to transfer the coating in the apertures to the base.

The squeegee is typically a rectangular flexible elastomeric plate, ⅛ to ¼ inch thick, secured to a wooden handle along one straight edge of the plate opposite a straight edge that is the scraping edge of the squeegee.

In a production environment, the squeegee must be cleaned periodically such as at an end of a shift or work break, or especially if there is a period of time between any successive screening or such as when more than one color is applied to the base. Consequently there is a constant need to clean the squeegee during the process and requiring much effort. Oftentimes, the situation is results in having a pile of "dirty" squeegees which grows until the technician must interrupt his production to clean his squeegee. The problem is particularly exacerbated by the collection of ink residue in the crevice created along the boundary between the handle and the elastomeric flexible plate. Particularly when fast drying inks are used, the squeegee becomes coated with ink that has dried or at least hardened and is therefore particularly difficult to remove.

Removal of the dried or semi-dried ink requires hard brushing with generous application of an appropriate solvent.

Numerous approaches to cleaning processes involving a combination of brushing and flushing have appeared for a variety of situations.

For example, U.S. Pat. No. 4,863,302 to Herzfeld et al discloses a brush for cleaning teeth including a bristle section connected to a tubular handle section which is connectable to a water supply.

U.S. Pat. No. 5,649,334 to Henriquez et al discloses a water and soap dispensing scrubber featuring connection to a water source and a soap reservoir with a pump for discharging a water soap mixture through a rotating brush.

U.S. Pat. No. 5,802,664 to Mondigo discloses a spray means for spraying a mixture of soap and water in combination with a rotating brush head.

None of these practices of the prior art are satisfactory in their application to the problem of cleaning the squeegees of present concern and so, it is common practice to resort to the manual process of dipping the common scrub brush in an appropriate solvent and scrubbing the squeegee by hand. The amount of pressure by the brush against the squeegee that must be exerted by the technician is tiring for the technician and also requires frequent replacement of the brushes. Drastic measures should be taken to protect the worker such as use of rubber gloves, adequate ventilation, eye shield etc.

SUMMARY OF THE INVENTION

It is an object of this invention to provide an apparatus and method for cleaning squeegees of the type having the edge of a flat elastomeric plate attached to a handle such as are used in the screen printing industry. It is a further object that the method and use of the apparatus be quick and convenient to implement with minimum exposure to fumes from the cleaning solvent and in term of contact of the skin to the solvent. It is a another object to use without modification, a brush that is readily available, inexpensive, has excellent characteristics in terms of bristle length, stiffness and durability and yet is conveniently replaceable when required.

This invention is directed toward an apparatus comprising a rack supporting two clamps holding a pair of flat brushes wherein the bristles of each brush face and are in contact with the bristles of the other brush. A pair of tubes is provided, each tube attached to a brush clamp adjacent to rows of bristle. Each tube has a row of apertures that direct a stream/spray of solvent against the sides of the squeegee as the squeegee is slideably inserted between the brushes. The brushes are spaced such that each brush scrubs a surface of the plate of the squeegee as the plate is swiped between the brushes, The clamp is designed for convenient replacement of each brush as the brush wears or the bristles lose their stiffness and for fine adjustment of space between brushes.

The rack is suspended in a tank that holds solvent. A pump recirculates solvent into the rack, out through the apertures in the tubing and bristles and against the surface of the squeegee.

DISCUSSION OF PREFERRED EMBODIMENTS

Figure 1:
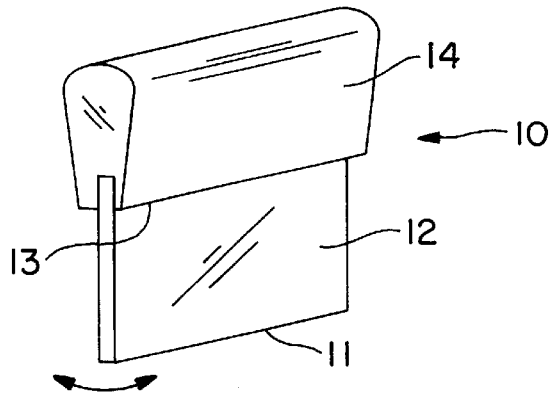
FIG. 1 PRIOR ART
FIG. 1 is a perspective view showing a squeegee of the type to be cleaned by the invention.

Turning now to a discussion of the drawings, FIG. 1 (prior art) shows a typical squeegee 10 to be cleaned according to the method and apparatus of this invention. The squeegee 10 includes a rectangular flexible elastomeric plate 12 having a joining edge 13 secured in an elongated handle 14 (typically wood) and the opposite edge being a scraping edge 11.

Figure 2:
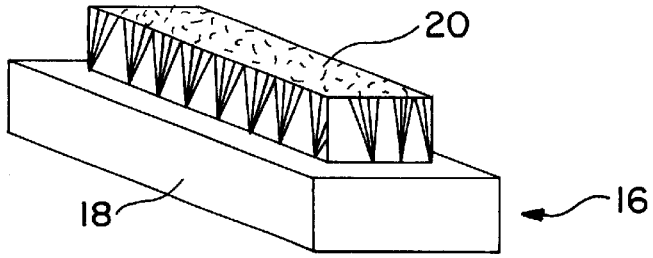
FIG. 2 PRIOR ART
FIG. 2 is a perspective view showing the brush used in the cleaning process.

The apparatus utilizes flat brushes 16 of the type shown in FIG. 2 having bunches of bristles 20 mounted on a rectangular base 18.

Figure 3:
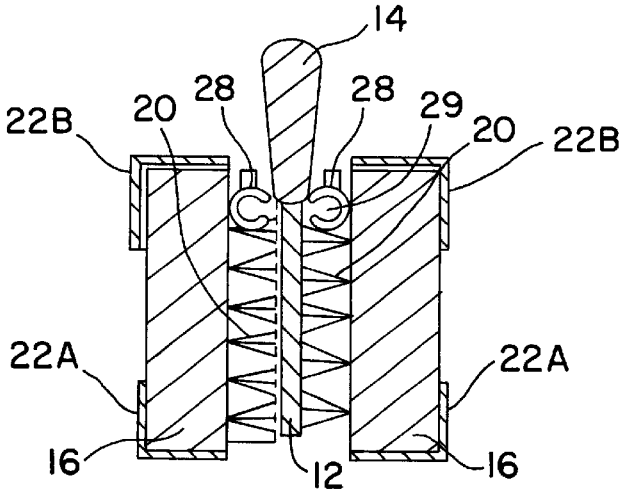
FIG. 3 is a sectional view of a squeegee held between a pair of brushes held in the rack of this invention.

FIG. 3 is a sectional view showing two brushes 16 mounted in the jaws 22A and B of a frame with the bristles 20 of each brush 16 facing one another. The frame includes a pair of tubes 28 with apertures 30 positioned to spray solvent through bristles 20 onto the flexible elastomeric plate 12 of squeegee 10 swiped between brushes 16.

Figure 4:
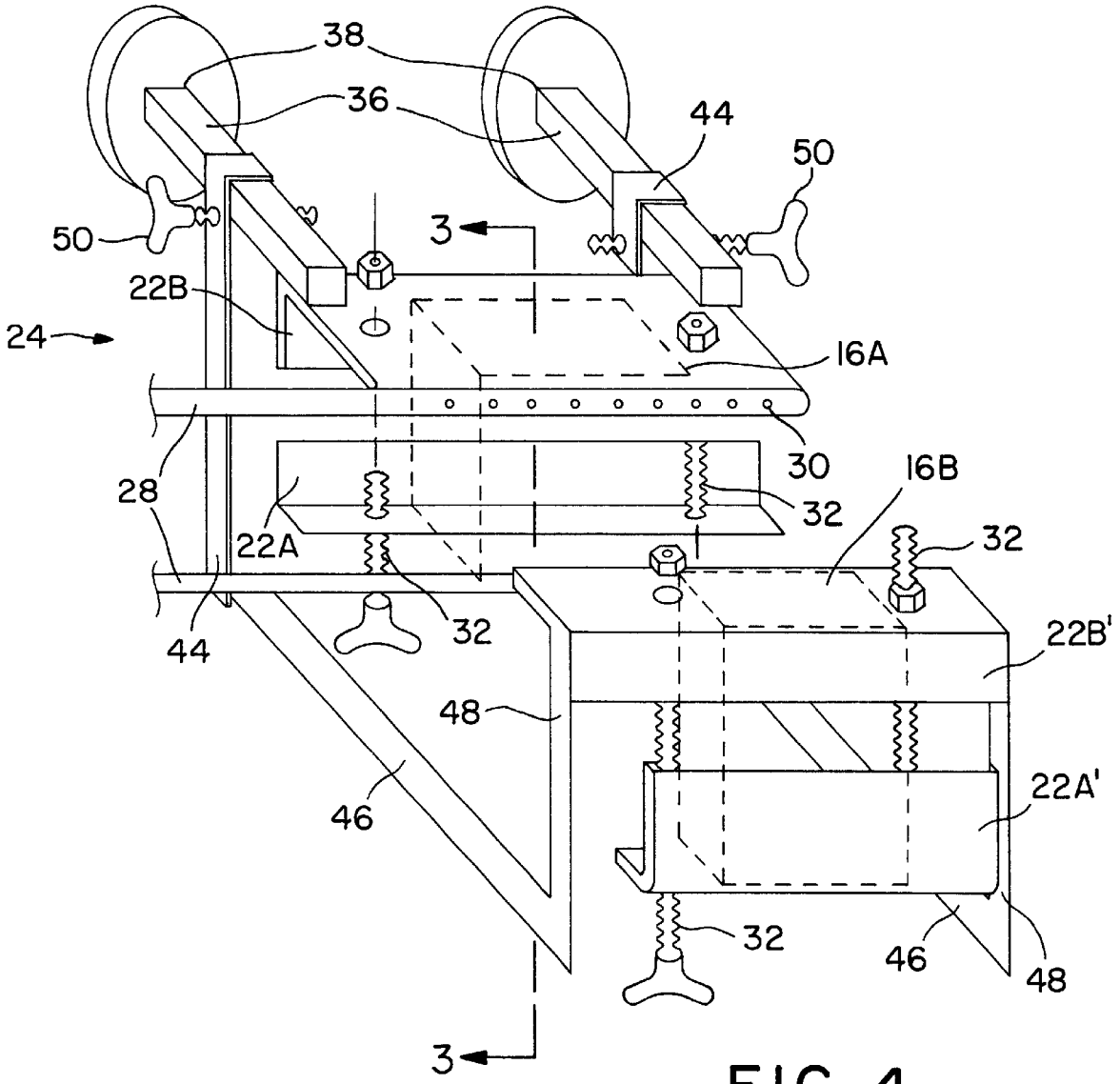
FIG. 4 is a perspective view showing details of the frame used to support the brushes.

FIG. 4 shows a frame 24 for holding the brushes 16A and 16B supported with bristles 20 facing one another as shown in FIG. 3. The frame 24 includes two sets of jaws, each set including an upper jaw 22B opposite lower jaw 22A positioned to clamp onto a respective brush 16A and B (shown in phantom in FIG. 4). Tubes 28 are shown each with a row of perforations 30 positioned to soak the flexible plate 12 as the squeegee is forced through the space between brushes 16A and 16B. Each tube is supported on the edge of an upper jaw 22B and 22B'. Lower jaw 22A is attached to upper jaw 22B by clamping bolts 32.

Figure 5:
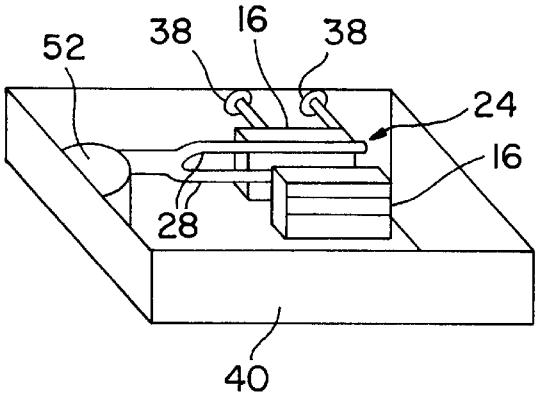
FIG. 5 is a perspective view showing the frame supporting the brushes in a tank in preparation for the squeegee cleaning operation.

A first set of jaws 22A and B is fixedly attached to the ends of a pair of parallel rails 36. As shown in FIG. 5, the opposite ends 38 of rails 36 are attached to the inside of a tank 40. A rack comprising arms 44, 46, 48, slidably mounted on rails 36, support the second set of jaws 22A' and 22B' relative to the first set of jaws 22A and 22B so that the space between brushes 16A and 16B can be adjusted by sliding arm 44 on rail 36 then tightening clamping bolt 50.

FIG. 5 is a perspective view showing the rack of this invention mounted in tank 40. The spray tubes 28 are shown connected to recirculating pump 52 which pumps solvent from out of the bottom of tank 40 and through the apertures 30 of tubes 28 against a squeegee positioned between bristles 20 of brushes 16.

Figure 6:
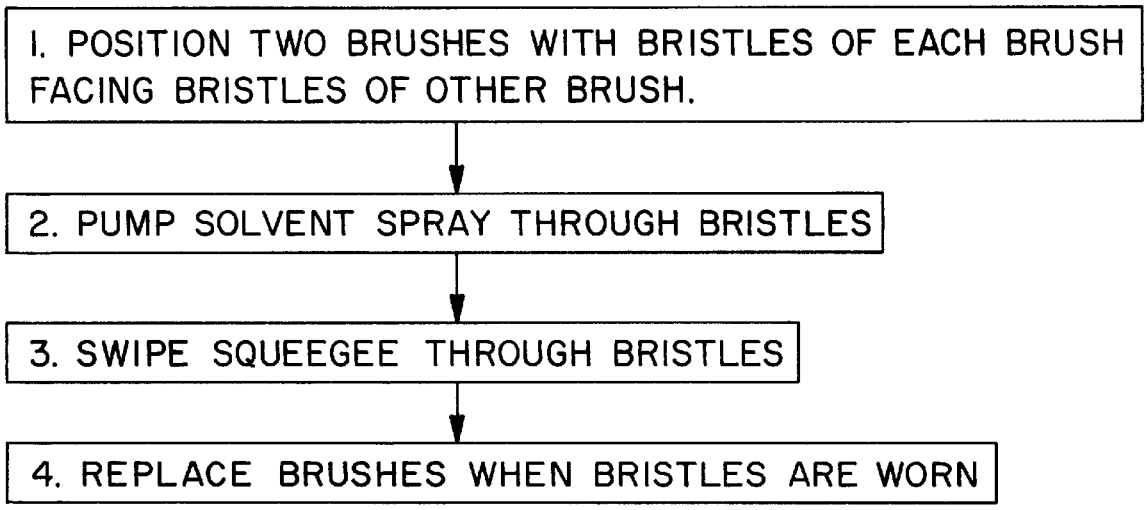
FIG. 6 is a flow diagram illustrating steps in the method of the invention.

The steps in the method of practicing the invention are listed in FIG. 6.

In step 1, a pair of flat brushes are supported with bristles of each brush facing and in contact with bristles of the other brush in a tank. The long dimension of each brush is horizontal. A pair of tubes are positioned with one tube along a top edge of one brush respectively. A row of apertures are formed along each tube so that solvent pumped through the tubes sprays out of apertures toward the other brush.

In step 2, Solvent is pumped through the tubes forming a spray which is captured in the tank and is recirculated.

In step 3, the squeegee to be cleaned is held by the wooden handle with the flexible member extending positioned between the brushes. The brush is swiped several times between the brushes so as to scrub both sides of the flexible plate simultaneously. Particular care is taken to scrub close to the union of the flexible plate and handle.

In step 4, when the brush has been worn out, either one or both brushes is replaced by loosening the clamping bolts, sliding the worn brush from out between the clamping jaws sliding a new brush into position between the clamping jaws, and retightening the clamping bolts.

There has been described a method for cleaning ink from the flexible elastomeric plate of a squeegee which is more convenient than the method of the present art. The method and apparatus can also be used to clean objects that are flat such as stencils, etc. The use of the brush having a handle that is substantially a rectangular parallelopiped as shown in FIG. 2 is particularly useful in cleaning the typical squeegee shown in FIG. 1 because it is well accommodated to cleaning the junction along the joining edge 13 of the elastomeric plate 12 and handle 14 where ink readily collects and is otherwise difficult to remove using practices of the prior art.

The system is especially amenable to fast production rate of cleaning particularly when the ink on the squeegee has not hardened. The process uses standard readily available inexpensive household brushes such as are used to scrub floors. In the embodiment described, brushes may be replaced very quickly and conveniently by loosening four bolts and sliding each brush from its respective clamping jaw.

Modifications and variations may be contemplated after reading the specification and studying the drawings which are within the scope of the invention. I therefore wish to define the scope of my invention by the appended claims.

I claim:

1. An apparatus for cleaning squeegees of the type having a handle with one edge joined to an edge of an elastomeric flat plate having a scraping edge, said one edge being distal from said scraping edge, said apparatus comprising:

a pair of brushes, each brush having a handle;

each brush having an array of bristles wherein ends of said bristles remote from said handle lie in a bristle surface remote from said handle;

said handle of said brush is substantially a rectangular parallelopiped with said array of bristles arranged on one side of said handle of said first and second clamps adapted for securing to said one brush and said another one brush respectively and arranged for supporting said brushes with said surfaces of said ends of said bristles facing one another; and arranged to permit selecting a distance of one said brush from another said brush permitting said distance be selected where said bristles from one said brush touch one side of said plate and said bristles from another said brush touch an opposite side of said plate when said plate is positioned between said brushes;

means for pumping solvent through bristles of each said brush against both sides of said flat plate when said flat plate is positioned between said brushes ennabling a user to hold said handle of said squeegee and scrub both sides of said elastomeric flat plate by manually reciprocally moving said elastomeric flat plate.

2. The apparatus of claim 1 comprising a tank;

said first and second clamps securely mounted in said tank;

said means pumping solvent being a pair of tubes;

means for supporting one of said pair of tubes between said handle of one said brush and one side of said elastomeric flat plate;

means for supporting another one of said tubes between said handle of another said brush and an opposite side of said elastomeric flat plate;

each tube having an array of apertures positioned to direct solvent flowing through each of said tubes against said elastomeric flat plate of said squeegee when said elastomeric flat plate is positioned between said brushes and said tubes;

each tube adapted for communicating with a pump providing that, solvent pumped by said pump is sprayed through said array of apertures from said respective tubes.

3. The apparatus of claim 2 wherein said means for supporting said brushes further comprises:

at least one rail having a first end secured to an inside surface of said tank and having a second end;

said first clamp having two jaws adapted to releasably secure a brush between said two jaws;

said first clamp secured to said at least one rail distal from said inside surface of said tank; and said second clamp having two jaws adapted to releasably secure a brush between said jaws;

said second clamp slideably mounted on said at least one rail intermediate between said first end of said rail and said first clamp whereby said another brush is slideable away from said one brush when it is required to replace said one brush and said another one brush and whereby said another one brush is slideable toward said one brush when it is required to clean said squeegee;

said means for supporting said one tube being a means for attaching said first tube along an upper edge of said first clamp; said means for supporting said another tube being a means for attaching said another tube along an upper edge of said second clamp.

* * * * *